United States Patent [19]

Artbauer

[11] 4,101,728

[45] Jul. 18, 1978

[54] GAS INSULATED HIGH VOLTAGE CABLE

[75] Inventor: Jan Artbauer, Hanover, Fed. Rep. of Germany

[73] Assignee: Kabel-und Metallwerke Gutehoffnungshutte Aktiengesellschaft, Hanover, Fed. Rep. of Germany

[21] Appl. No.: 827,615

[22] Filed: Aug. 25, 1977

[30] Foreign Application Priority Data

Aug. 27, 1976 [DE] Fed. Rep. of Germany ..... 2638610

[51] Int. Cl.[2] ..... H01B 9/06

[52] U.S. Cl. ..... 174/29; 174/16 B; 174/117 R

[58] Field of Search ..... 174/28, 29, 27, 113 R, 174/113 AS, 16 B, 117 R, 117 F, 34

[56] References Cited

U.S. PATENT DOCUMENTS

| | | | |
|---|---|---|---|
| 716,155 | 12/1902 | West | 174/27 |
| 2,204,737 | 6/1940 | Swallow et al. | 174/29 X |
| 2,215,290 | 9/1940 | Hobart | 174/29 X |
| 2,580,838 | 1/1952 | Rhodes | 174/29 |
| 3,919,456 | 11/1975 | Floessel | 174/27 |
| 4,059,723 | 11/1977 | Floessel | 174/27 X |

FOREIGN PATENT DOCUMENTS

| | | | |
|---|---|---|---|
| 642,142 | 2/1937 | Fed. Rep. of Germany | 174/27 |
| 397,262 | 8/1933 | United Kingdom | 174/27 |
| 438,560 | 11/1935 | United Kingdom | 174/27 |

*Primary Examiner*—Arthur T. Grimley
*Attorney, Agent, or Firm*—Ralf H. Siegemund

[57] ABSTRACT

The cable is constructed so that the inner conductor has an asymmetric contour, configuration or position in the outer conductor to reduce the field strength in some zones of the cable while the inner conductor is held in the tubular interior of the cable in such a manner so that zones of increased field strength are bridged by spacer material.

11 Claims, 7 Drawing Figures

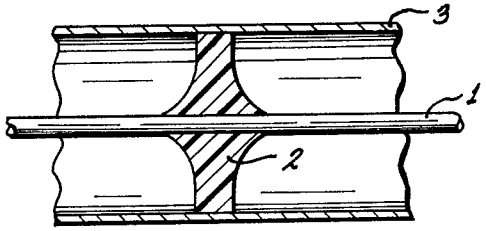
PRIOR ART
FIG. 1
FIG. 2
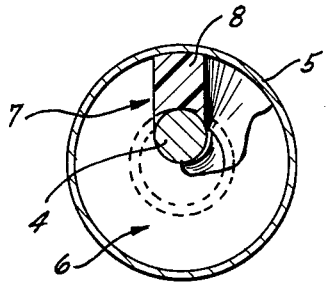
FIG. 3
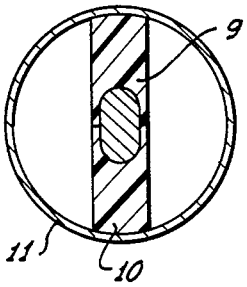
FIG. 4
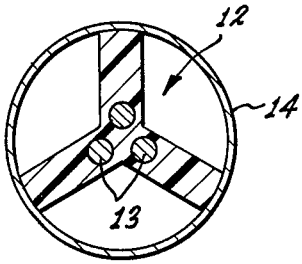
FIG. 5
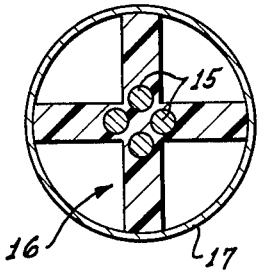
FIG. 6
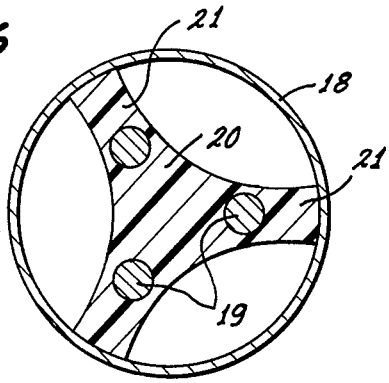
FIG. 7
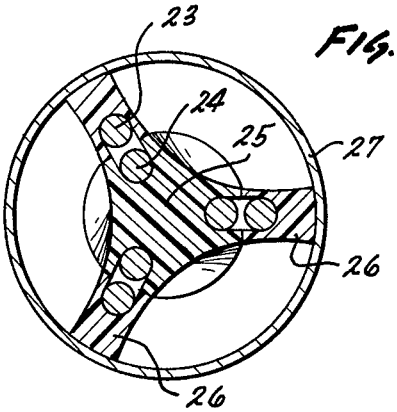

GAS INSULATED HIGH VOLTAGE CABLE

BACKGROUND OF THE INVENTION

The present invention relates to a gas insulated cable particularly of the variety used for transmitting high or very high voltages.

Gas insulated cables are usually of tubular construction, and a conductor or conductors are positioned therein by means of spacers in particular relation with respect to each other as well as to the tubular jacket. In a typical case, an inner conductor is provided as a tube or is constructed from stranded wires. This conductor is held concentrically inside of a metal tube of correspondingly large diameter whereby disc shaped, funnel shaped or other kinds of elements provide for the supporting function. The interior of the outer tube, i.e. the space between the latter and the inner conductor, is filled with a gas such as $SF_6$, which is the most commonly used insulating gas today.

The insulative strength of such a coaxial cable depends upon the quality of the insulation in general as well as upon the geometry of the cable, i.e. the radial distance between inner conductor and outer tube. The gas insulation as such is quite poor from a general point of view, so that the transmission of high voltages usually require the cables to have larger diameters. Not only are large diameter cables rendered more expensive than small ones on account of increased cost in manufacturing, but handling of thick cable such as transportation, installation, etc., is cumbersome and compounds the problem.

The insulative strength of such a gas filled cable can be increased to some extent by increasing the gas pressure. However, the relation between these parameters requires a rather steep increase in pressure to obtain a modest increase in insulative strength. Moreover, a pressure increase is often accompanied by an increase in impurities which reduce the insulative properties of the cable. Thus, additional steps have to be taken to clean the gas before filling the cable. Another problem is to be seen in the fact that the liquifying temperature or boiling point of $SF_6$ increases with pressure to such an extent that it readily approaches the operating temperature of the cable. It can thus be seen that increasing the gas pressure is of limited value for enhancing insulation of a gas filled cable.

DESCRIPTION OF THE INVENTION

It is an object of the present invention to increase the insulative strength of a gas filled cable without requiring the commensurate, commonly practiced increase in dimensions and/or gas pressure.

In accordance with the present invention, it is suggested to construct a gas filled cable by means and under utilization of a tubular, outer conductor and an inner conductor or conductors configured and/or disposed so that the complete symmetry in relation to the axis of the outer conductor (or in relation to the inner surface of the outer conductor) is disturbed, resulting in a non uniform electric field distribution, particularly around the inner conductor; the zone, area or region of highest electric field strength is occupied by spacer material which positions the inner conductor in the outer conductor; the remainder of the space between the conductors is filled with insulative gas.

The asymmetry and irregular field distribution mentioned above is produced either by an eccentric disposition of the inner conductor or by a non-round contour, either of the conductor itself or by using a plurality of inner conductors, around which the field strength (in radial direction)varies in magnitude. Utilization of a non-round inner conductor or of a conductor assembly with overall non-round contour establishes different radii of curvature as well as different distances from the outer conductor; either or both establish different adjacent field strength. It should be mentioned that the invention is not to be seen in introducing an irregularly contoured inner conductor into a round outer tube. Rather, it is intended to introduce localized reductions in electric field strength into the cable, being accompanied necessarily by adjacent zones of increased local field strength, and these latter zones are occupied by spacer material.

Due to the fact that the inner conductor may have a certain surface roughness, it may be desirable to embed the conductor in (solid) insulating material but to bridge completely only the space between the surface portion of the inner conductor having highest curvature and/or shortest distance to the outer conductor. Embedding the inner conductor eliminates also the influence of impurities of the gas. Contouring of the spacer as such serves also for controlling the field distribution generally and in the adjacent gas filled zone in particular. A further means for control of the distribution of the electric field is established by providing the spacer with a conductive coating adjacent the conductors.

Generally speaking, the spacer will extend lengthwise to the cable axis because a zone of maximum field strength exists in any cross section. The spacer should, however, have a helical configuration to obtain a flexible configuration and construction of the cable. Accordingly, the inner conductor, or its eccentric position and/or the specific points of closest distance to the outer conductor should be located on curves of corresponding helical configuration.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a longitudinal section view through a gas filled cable of conventional construction; and, FIGS. 2 through 7 are cross-sections through different cables in accordance with the preferred embodiment of the invention.

Proceeding now to the detailed description of the drawings, FIG. 1 illustrates an inner conductor, e.g. a tube 1 being disposed in an outer, metal tube 3 and being held therein by means of individual spacers 2. Characteristically, this concentric system is of symmetric construction with respect to the axis of conductor 1 which is made to coincide with the axis of tube 3.

FIG. 2 illustrates a similar outer tube 5 made of metal, and an inner conductor 4 is disposed therein, and in eccentric relation thereto. In other words, the two elements 4 and 5 do not have a coaxial disposition to each other. Thus, the system 4–5 exhibits zones or areas of high electric field strength 7, and zones or areas of low electric field strength 6. For a given relation between insulative strength(break-down voltage on a per unit length basis) of the chosen gas (e.g. $SF_6$), the distance between the conductors and the gas pressure, one can increase the operating voltage so that the field strength in zone 6 increases to a value a coaxial system would have (other parameters being the same). That increase in voltage, however, will raise the field strength in zone 7 to unduly high values. The increase is a two fold one, one resulting from the eccentric disposition, i.e. from the diminished distance between the conductors, the other one results from the contemplated voltage increase. However, the zone 7 is now occupied by a spacer 8. Thus, the zone of highest field strength is bridged by solid insulating material and is, therefore, rendered independent from the insulative properties of the gas which fills the unoccupied space between the eccentric conductors 4 and 5. The degree of eccentricity is a parameter that is available for controlling the field distribution in the cable, particularly in the gas filled interior of tube 5.

In a simple configuration, spacer 8 could be a flat bar with appropriately contoured small sides, matching the curvature of the conductors 4 and 5. Such a configuration, however, has little flexibility. Thus, it is preferred to configure the spacer 8 as a helix which requires the inner conductor 4 to have likewise a helical configuration because the rule must be maintained throughout that spacer material occupy the zones of shortest distance between the eccentrically positioned inner and outer conductors.

A similar effect is produced in the device as shown in FIG. 3; however, not on the basis of eccentric positioning but by means of an asymmetric construction of the inner conductor 9. This conductor 9 has an overall, oval or oblong cross-section, either on account of forming the conductor in that manner or by operation of strengthing or twisting two conductors about each other. A third variation includes two twisted conductors about which a metal ribbon has been wound to obtain a single surface configuration of oblong cross-section.

This conductor or conductor assembly 9 is disposed in a metal tube 11 by means of a bi-parted, helical spacer 10 which follows the twist of the conductor(s) 9 so that the shortest distance between the conductor 9 and the tube 11 is occupied by spacer material. Asymmetry in the field distribution is produced here in a twofold manner. Once, the oblong ends of the conductor as far as the cross-section is concerned, pertain to surface portions of that conductor which have a smaller radius of curvature. That alone produces a larger local field strength than elsewhere on the conductor. In addition, the sharply curved surface portions of the conductor 9 have a shorter distance from the outer conductor 11. Therefore, these zones are bridged and occupied by spacer material. For reasons of flexibility, the assembly consisting of spacer 10 and conductor 9 may be twisted about the axis of conductor 9. This is required if 9 consists of two circular conductors which have been twisted about each other. The spacer twist must follow the twist of the conductors. The spacer 10 actually embeds the conductor 9 completely to obtain a better field distribution in the gas filled space.

Another relevant aspect of the construction which may also be applicable to FIG. 2, is to be seen in that one may provide a metal coating on those surface portions of the spacer (8, 10) which are in contact with or adjacent to the conductors. This aids in the control of the field distribution and may have a beneficial effect if the outer conductor is corrugated. The metal coating on the radially outwardly directed surface of the spacer may serve here as an electrode.

FIG. 4 illustrates three inner conductors 13 which are twisted but may remain spaced apart from each other. They are, in fact, embedded in a spacer 12 which has a star-shaped cross-section resulting in three support ridges. The entire spacer plus inner conductor sub assembly may be twisted about the common axis of the system. Each conductor 13 is disposed in eccentric relation to the axis of tube 14, and the zone of shortest distance between each conductor and tube 14 is occupied by the respectively associated spacer ridge.

FIG. 5 differs from FIG. 4 merely by the number of conductors 15 of the inner conductor system, and by the corresponding number of ridges of the spacer 16 positioning the conductors in the tube 17.

The examples shown in FIGS. 2 to 5 are all of the type in which the inner conductor or conductors conduct a single phase or polarity. FIGS. 6 and 7 illustrate examples of three-phase systems. FIG. 6 in particular depicts an outer tube 18 housing three conductors 19. The insulating elements 21 provide for the requisite insulation between the individual conductors and the outer tube 18. These elements 21 may be integral parts of the support helix 20 or may have been connected thereto, while actually being individual helices.

This latter aspect is actually illustrated in FIG. 7 showing a central support element 25 with a helical twist, and three outer helices 26 are connected to the central spacer 25, following its twist. In other words, the central spacer element 25 is twisted about its own axis thereby establishing helical support areas for the conductor pairs, and the complementary spacer elements 26 are helices which extend along the inner surface of the outer conductor 27. Of course, whenever flexibility is not a requirement, or can be established by choice of the material, twisting and helical configuration of the spacer is not needed.

The three phases are conducted in this example by conductor pairs, each consisting of two conductors such as 23, 24. These conductors may be twisted about each other independently from the twist of the spacer configuration.

Concerning all examples as illustrated, including particularly the spacers therein as well as the parts of which they are composed, they all may have been extruded, using high density polyethylene, poly propylene or other known polymers which can be used for that purpose. It should be noted that in the past extruded insulation or parts thereof as well as the manufacturing of cable with large cross-sections was deemed troublesome for reasons stated above as well as on account of deformation of the insulation during handling, eccentricity in the conductor position, tension in the insulation, cavities at unwanted locations, etc.; all these problems lose their significance on account of the intended and introduced eccentricity or other asymmetries.

The outer tube is preferably made for longitudinally paid, metal strip which is folded about the spacer-plus-inner-conductor subassembly, to obtain a tube which is welded along the adjoining strip edges, and is subsequently corrugated. This method permits continuous production of a gas insulated high voltage cable which can be reeled and particularly wound upon drums for transport to the installation site.

The invention is not limited to the embodiments described above but all changes and modifications thereof not constituting departures from the spirit and scope of the invention are intended to be included.

I claim:

1. A gas insulated high voltage cable, comprising:

an outer tubular metal conductor having an inner surface and a tubular interior;

at least one conductor disposed in the outer conductor and having a surface which is asymmetrical with respect to the inner surface of the outer conductor so that the electric field strength in the tubular interior varies around the inner conductor; and insulative spacer means supporting the inner conductor in the outer conductor and occupying zones of maximum electric field strength in the tubular interior of the outer conductor and in any cross-section of the cable.

2. A cable as in claim 1, wherein said inner conductor is eccentrically disposed in the outer conductor, the space being disposed in all zones of shortest distance between the inner and outer conductors.

3. A cable as in claim 1 wherein the inner conductor has non-round cross-section, the spacer being disposed in all zones of shortest distance between the inner conductor and the outer conductor.

4. A cable as in claim 1, wherein the spacer has a contour extending along the inner surface of the outer conductor and along a path of shortest distance of the outer conductor to the inner conductor.

5. A cable as in claim 1 having a plurality of inner conductors, the spacer means constructed to bridge the shortest distance of each of the inner conductors to the inner surface.

6. A cable as in claim 1 wherein the spacer means is provided with an electrically conductive layer, at least adjacent to one of the conductors.

7. A cable as in claim 1 wherein the spacer means includes a plurality of spacer elements combined to support the inner conductor.

8. A cable as in claim 1 wherein the inner conductor has different radii of curvature, and is disposed so that portions of the conductor having smallest radius of curvature are closest to the outer conductor, the spacer means constructed to bridge a radial zone as extending from the smallest radius portion of the conductor.

9. A cable as in claim 1 wherein the zone of highest field strength varies azimuthally along the cable axis, the spacer means following the azimuthal variation.

10. A cable as in claim 1 said inner conductor being comprised of plural conductors twisted about each other, the spacer means constructed to follow the twist along the extension of the cable.

11. The cable as in claim 1 wherein the inner conductor is embedded in spacer material, only a portion thereof extending to the outer conductor.

* * * * *